US005967361A

United States Patent [19]

Darnell

[11] Patent Number: 5,967,361

[45] Date of Patent: Oct. 19, 1999

[54] DUMPSTER-TYPE REFUSE CONTAINER AND METHOD

[75] Inventor: G. Kevin Darnell, 2020 E. Edgewood Dr. - #70, Lakeland, Fla. 33803

[73] Assignees: Anthony R. Martorana; Ross A. Pedigo; G. Kevin Darnell, all of Lakeland, Fla.

[21] Appl. No.: 09/019,961

[22] Filed: Feb. 6, 1998

Related U.S. Application Data

[63] Continuation-in-part of application No. 29/063,559, Dec. 10, 1996, Pat. No. Des. 389,970.

[51] Int. Cl.[6] ..... B65D 45/00

[52] U.S. Cl. ..... 220/623; 220/908

[58] Field of Search ..... 220/908, 1.5, 608, 220/623, 646

[56] References Cited

U.S. PATENT DOCUMENTS

| | | | |
|---|---|---|---|
| D. 62,959 | 8/1923 | Olsen . | |
| D. 229,473 | 12/1973 | Henry . | |
| D. 263,016 | 2/1982 | Keller . | |
| D. 274,665 | 7/1984 | Hobbs et al. . | |
| D. 318,164 | 7/1991 | Marzocchi, Jr. . | |
| D. 335,560 | 5/1993 | Fennell, Jr. . | |
| 1,040,014 | 10/1912 | Rhodes . | |
| 1,104,055 | 7/1914 | Lowe . | |
| 1,218,449 | 3/1917 | Nickum . | |
| 1,351,747 | 9/1920 | Flinn . | |
| 1,692,170 | 11/1928 | Ives et al. . | |
| 2,864,526 | 12/1958 | Buss . | |
| 3,138,275 | 6/1964 | Dempster et al. . | |
| 3,823,972 | 7/1974 | Ramer . | |
| 4,158,424 | 6/1979 | Carmack . | |
| 4,335,828 | 6/1982 | Robinson et al. . | |
| 4,538,512 | 9/1985 | Blough . | |
| 4,726,616 | 2/1988 | Schmidt . | |
| 4,844,285 | 7/1989 | Coff . | |
| 5,007,547 | 4/1991 | Corbett | 220/908 X |
| 5,011,036 | 4/1991 | Souza et al. | 220/908 X |
| 5,049,024 | 9/1991 | Chien . | |
| 5,071,166 | 12/1991 | Marino . | |
| 5,118,000 | 6/1992 | Howell et al. | 220/908 X |
| 5,423,448 | 6/1995 | Pedigo . | |
| 5,490,606 | 2/1996 | Lombardo . | |

FOREIGN PATENT DOCUMENTS

| | | |
|---|---|---|
| 3321317 | 12/1984 | Germany . |
| 4032946 | 4/1992 | Germany . |

OTHER PUBLICATIONS

Translation of Portions of DE 4032946 A.

*Primary Examiner*—Steven Pollard
*Attorney, Agent, or Firm*—Allen, Dyer, Doppelt, Milbrath & Gilchrist, P.A.

[57] ABSTRACT

A dumping styled refuse container comprises left and right side walls each having lower edge portions for positioning on a support surface for the container and a cylindrical shaped bottom wall having a concave inner surface whose surface extends from left to right. The bottom wall is attached to the left and right side walls in spaced relation to lower edges of the left and right side walls for suspending the arcuate bottom wall from the ground upon which the container is placed. As a result, refuse collected in the container has liquids that settle in a well defined line along the lowest portion of the bottom wall. A drain hole becomes more effective that foe a typically flat bottomed container, and easier, less costly repair and replacement of rusted portions results. In addition, the curved bottom wall permits a user to more closely approach the container when depositing refuse therein. Lower edges of the left and right side walls include a horizontally extending flange for providing a foot which contacts the support surface upon which the container rests. Lifting sleeve are attached to each of the left and right side walls have an opening for receiving the tine of the fork lift therein. Struts extend between the foot flange and the sleeves for providing additional support to the container when being positioned on the support surface by the fork lift, thus relieving the left and right side walls from the stress.

33 Claims, 3 Drawing Sheets

DUMPSTER-TYPE REFUSE CONTAINER AND METHOD

CROSS REFERENCE TO RELATED APPLICATION

This application is a continuation-in-part application of application Ser. No. 29/063,559 filed Dec. 10, 1996, commonly assigned with the present invention and now U.S. Pat. No. D389,970.

BACKGROUND OF INVENTION

1. Field of Invention

The present invention relates generally to refuse containers, and more particularly to dumping styled containers operable with front end loading fork lifts.

2. Description of Background Art

Dumping styled refuse or trash containers operable with front end loading equipment are well known in the art, and are often referred to as "dumpsters." Typically, such containers are built with a relatively large, flat bottom. Sides, including left, right, front and rear, are then welded to the bottom. With such a structure, the containers rests or is supported by its bottom. As is known for such a box shaped container, multiple corners result. It is these corners, for example, those formed by the bottom, left, and front sides, that collect refuse which is difficult to remove with the typical tilting of the container for dumping refuse therefrom. The refuse that remains in such corners causes corrosion and rusting of the container to the point of ineffectiveness, and replacement is required. If repair is attempted, typically, the entire bottom must be replaced, as well as large sections of the vertical walls. Such a repair and replacement process is relatively expensive and time consuming. There is large material cost because of the large rusted surface area that must be replaced. Simply cutting out specific rusted areas is impractical and difficult.

U.S. Pat. No. 4,726,616 to Schmidt discloses a dumster type trash container in which the bottom wall and the lower portion of the side walls are formed of a heavier gauge material to eliminate premature corrosion failures of the container. Ends of the heavier gauge bottom are inclined upward to place the weld joint above anticipated liquid levels. Schmidt '616, as well as those skilled in the art, recognize the problem of corrosion and the costly results. As disclosed by Schmidt '616, the heavier gauge bottom adds weight to the container, and recognizes that costs for the container are increased.

Typically, as illustrated in Schmidt '616, and by way of example, in U.S. Pat. No. 5,490,606 to Lombardo and U.S. Pat. No. 3,138,275 to Dempster et al, relatively large surface areas of the bottom remain under water, or the liquid draining from refuse placed in the container. In addition, the prior art has directed improvements to the dumpster style refuse container to the dumping aspects of the container. In addition to the flat bottom, a squared off bottom to side wall is typical, as illustrated again with reference to the above cited art. Operation of the refuse container includes use by the person placing the refuse therein.

Improvements are needed that address the human factors aspect of its use, including the ability to approach the container as closely as possible without unnecessary strain. The prior art has not addressed this issue. Further, although skids are well known to be placed on the outside bottom wall surface to reinforce the bottom wall and lift it above the ground, as described in U.S. Pat. No. 4,335,828 to Robinson et al, by way of example, such create nesting areas for pests. There is thus a need for a dumpster styled refuse container that minimizes the effect of rusting on performance, permits a cost effective alternative for repair and replacement of container elements, and is "user friendly" for the person depositing refuse in the container prior to the dumping of the refuse therefrom. The present invention is directed to meet these needs.

SUMMARY OF INVENTION

In view of the foregoing background, it is therefore an object of the present invention to provide a dumster type refuse container having enhanced longevity, serviceability and inexpensive maintenance needs when compared to typical containers. It is further an object to provide a refuse container that provides ease of use when in its stored location, available for receiving refuse from a user. It is further an object of the present invention to provide such a container that uniformly distributes its contents.

This and other objects, advantages and features of the present invention are provided by a dumping styled refuse container for storing refuse and accommodating a fork lift for dumping refuse therefrom. The refuse container comprises left and right side walls each having lower edge portions for positioning on a support surface for the container, an arcuate bottom wall having a concave inner surface, and fork lift receiving means for receiving tines of a fork lift in facilitating dumping of refuse from the container. The receiving means are attached to each of the left and right side walls.

In one preferred embodiment of the present invention, the bottom wall is integrally formed with front and rear side walls. The bottom, front side and rear side walls have left and right edge portions sealably attached to the left and right side walls, respectively, for defining a chamber having a top wall opening through which refuse is passed for being carried within the chamber. The bottom wall is attached to the left and right side walls in spaced relation to the lower edge portions of the left and right side walls, thus suspending the bottom wall from the support surface used by the container.

In a preferred embodiment, the arcuate bottom wall has a cylindrical shape with an axis of the cylinder forming the shape extending horizontally between the left and right side walls for creating a convex forward and rear portion of the bottom wall. The lower edge portions of the left and right side walls include a horizontally extending flange for providing a foot which contacts the support surface upon which the container rests.

In one embodiment of the present invention, the left and right side walls have a rear edge portion of greater length dimension than a front edge portion, thus providing an inclined top wall opening into the chamber. With such an arrangement, the front side wall is shorter than the rear side wall.

The fork lift receiving means of one embodiment comprises left and right sleeve members attached to each of the left and right side walls. The sleeve members are formed on outside surfaces of the left and right side walls and have an opening for receiving the tine of the fork lift therein. In a preferred embodiment, a support member extends from and is connected between the flange of the side walls and the sleeve member for providing additional support to the container when positioned on the support surface. The support member transmits stress placed on the sleeves to the support surface through the support member, thus relieving the left and right side walls from the stress.

For additional strength, a peripheral flange portion is included for defining a rim along a peripheral edge of the top wall opening into the chamber. The peripheral flange supports a lid hingedly attached to the container for covering the top wall opening. At least one of the left and right side walls includes a drain hole positioned proximate a bottom most position of the arcuate bottom wall.

Another aspect of the present invention is included in a method for fabricating the dumping styled refuse container. The method comprises the steps of providing left and right side walls each having lower edge portions for positioning on a support surface for the container, sealably attaching edge portions of the front and rear side walls to the left and right side walls, respectively, for defining a chamber having top and bottom wall openings, providing an arcuate bottom wall, and sealably attaching an arcuate bottom wall to the side walls in spaced relation to the lower edge portions of the left and right side walls. This suspends the bottom wall from the support surface for the container and provides the chamber for receiving refuse through the top opening. Further, fork lift receiving means are attached to the left and right side walls for receiving tines of a fork lift in facilitating dumping of refuse from the container.

BRIEF DESCRIPTION OF DRAWINGS

A preferred embodiment of the invention as well as alternate embodiments are described by way of example with reference to the accompanying drawings in which.

DETAILED DESCRIPTION OF PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
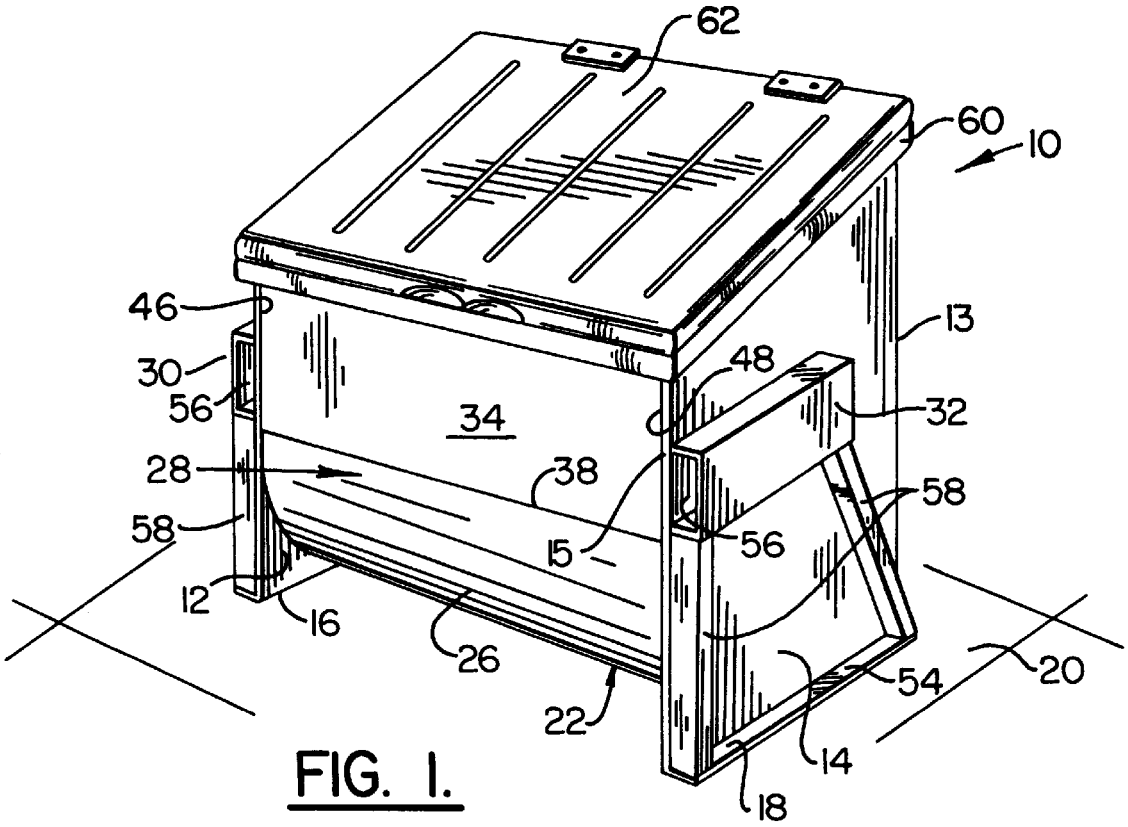
FIG. 1 is a perspective view illustrating a dumpster type refuse container of the present invention.
Figure 2:
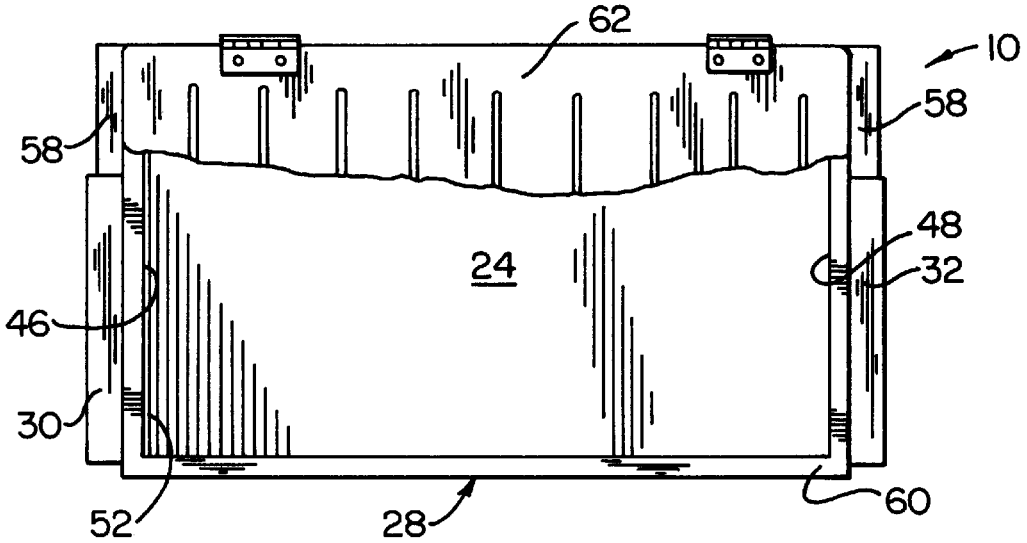
FIG. 2 is a cut-away top view of the container of FIG. 1.
Figure 3:
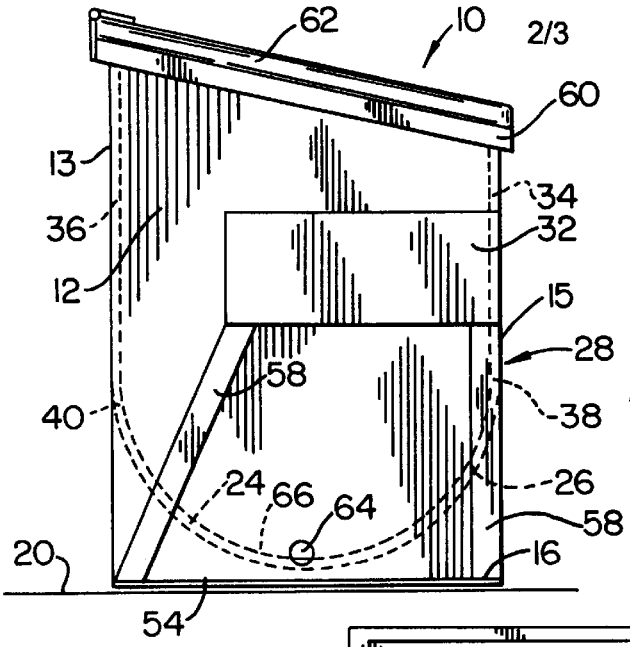
FIG. 3 is a left side elevation view of the embodiment of FIG. 1.

Referring now to FIGS. 1–3, the invention is first described by a dumping styled refuse container 10 for storing refuse and accommodating a fork lift for dumping the refuse therefrom. The refuse container 10 comprises left and right side walls 12, 14 each having lower edge portions 16, 18 for positioning on a support surface 20 for the container. An arcuate bottom wall 22 has a concave inner surface 24. In a preferred embodiment of the present invention, sheet steel material is used for the walls of the container 10. Therefore, the bottom wall 22 has a convex outer surface 26 which serves well to permit a user to closely approach the front 28 of the container 10. Fork lift receiving means for receiving tines of a fork lift in facilitating dumping of refuse from the container 10 is provided by left and right lifting sleeves 30, 32. The sleeves 30, 32 are attached to each of the left and right side walls 12, 14.

Figure 4:
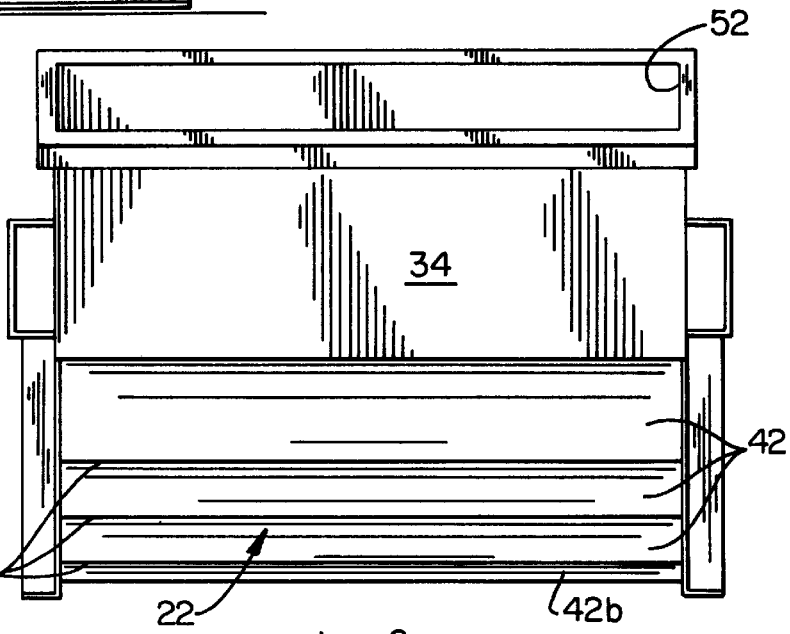
FIG. 4 is a front elevation view of an alternate embodiment of the container of FIG. 1.
Figure 5:
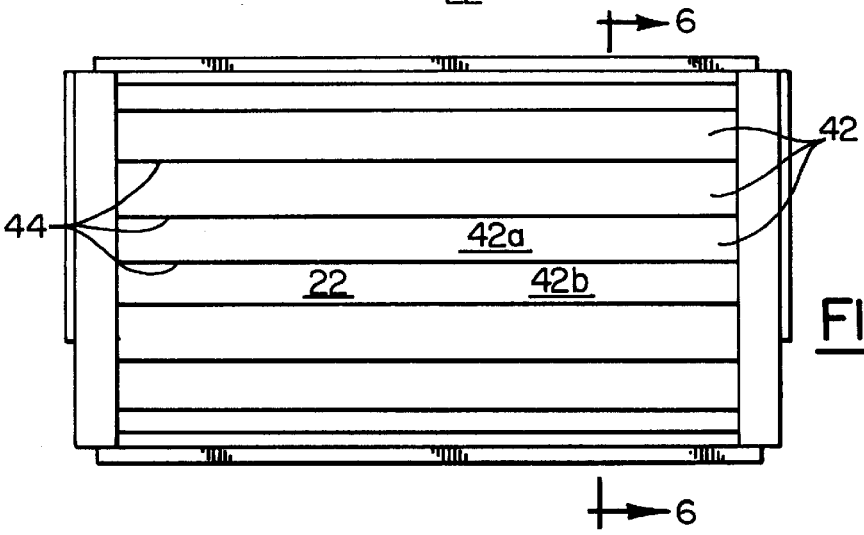
FIG. 5 is a top plan view of the embodiment of FIG. 4.
Figure 6:
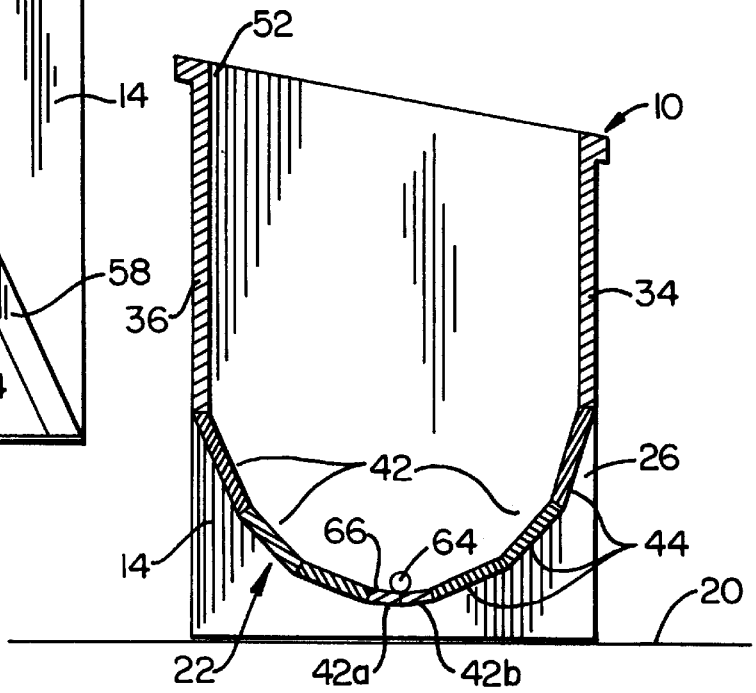
FIG. 6 is a cross-sectional view taken through lines 6—6 of FIG. 5.

In a preferred embodiment of the present invention, the bottom wall 22 is integrally formed with front and rear side walls 34, 36. In one embodiment, as illustrated with reference again to FIG. 3, the bottom wall 22 is formed from rolled steel and welded along front and rear edges 38, 40. Alternatively, a plurality of sheets 42 from flat stock are welded along their respective edges 44 and formed into the arcuate bottom wall 22 as illustrated with reference to FIGS. 4–6.

As illustrated again with reference to FIGS. 1–3, the bottom wall 22, front side wall 34 and rear side wall 36 have left and right edge portions 46, 48 sealably attached to the left and right side walls 12, 14, respectively, for defining a chamber having a top wall opening 52, defining the container opening through which refuse is passed for being carried within the chamber 10.

As illustrated again with reference to FIG. 1, 3 and 6, the bottom wall 22 is attached to the left and right side walls 12, 14 in spaced relation to the lower edge portions 16, 18 of the left and right side walls, thus suspending the bottom wall from the support surface 20, typically the ground area used to store the container 10. It is expected that various arcuate shaped bottom walls may be used, however, in a preferred embodiment, the arcuate bottom wall 22 has a cylindrical shape with an axis of the cylinder forming the shape extending horizontally between the left and right side walls 12, 14 for creating the convex shaped forward and rear bottom wall portion 26.

As illustrated with reference again to FIGS. 1 and 3, by way of example, the lower edge portions 16, 18 of the left and right side walls 12, 14 each include a horizontally extending flange 54 for providing a foot which contacts the support surface 20 upon which the container 10 rests and prevents the sides from digging into the support surface. In a preferred embodiment, the left and right side walls 12, 14 each have a rear edge portion 13 of greater length dimension than a front edge portion 15, thus providing an inclined top wall opening 52 into the chamber 50. With such an arrangement, the front side wall is shorter than the rear side wall.

Figure 7:
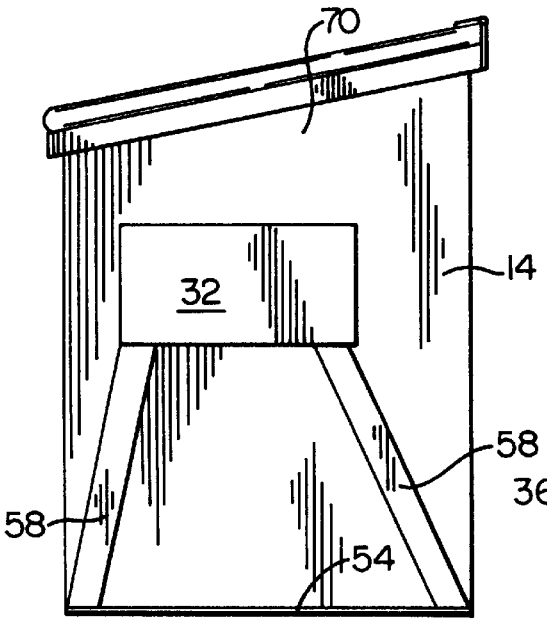
FIG. 7 is a right side elevation view of an alternate embodiment of FIG. 1.

As earlier described with reference to FIGS. 1–3, the fork lift receiving means comprises left and right sleeves 30, 32 attached to each of the left and right side walls 12, 14. The sleeves 30, 32 are formed on outside surfaces of the left and right side walls and have an opening 56 for receiving the tine of the fork lift therein. In a preferred embodiment, support members or struts 58 extend from and are connected between the flange 54 of the side walls and the respective sleeve 30, 32 for providing additional support to the container when positioned on the support surface 20. The struts transmit stress placed on the sleeves 30, 32 to the support surface 20, thus relieving the left and right side walls 12, 14 from the stress. As illustrated with reference to FIG. 7, the sleeves represented by sleeve 32, for example in discussion, may be positioner between and spaced from the front and rear side walls and proximate a center portion 70 of the left and right side walls 12, 14 for redistributing load on the left and right side walls.

For additional strength, a peripheral flange 60 is included for defining a rim along a peripheral edge of the top wall opening 52 into the chamber 50. The peripheral flange 60 supports a lid 62 hingedly attached to the container 10 for covering the top wall opening 52.

As illustrated with reference again to FIGS. 3 and 6, at least one of the left and right side walls 12, 14 includes a drain hole 64 positioned proximate a bottom most position 66 of the arcuate bottom wall. The arcuate shape of the bottom wall 22 lends itself well to optimizing the effectiveness of such a drain hole 64 for extending the life of the bottom wall 22. In addition, when rusting does occur to the point of rendering the container ineffective, only a narrow line or strip illustrated by dashed lines 68 of FIG. 2, needs to be replaced, or a pair of narrow sheets 42*a*, 42*b*, as illustrated with reference to the embodiment of FIGS. 4–6.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and alternate embodiments are intended to be included within the scope of the appended claims.

That which is claimed is:

1. A dumping styled refuse container for storing refuse and accommodating a fork lift for dumping refuse therefrom, the refuse container comprising:

left and right side walls each having lower edge portions for positioning on a support surface for said container;

a fixed arcuate bottom wall having a concave inner surface and a convex outer surface, said bottom wall integrally formed with front and rear side walls, said bottom wall, front and rear side walls having left and right edge portions sealably attached to said left and right side walls, respectively, for defining a chamber having a top wall opening through which refuse is passed for being carried within the chamber, said arcuate bottom wall attached to said left and right side walls in spaced relation to the lower edge portions of said left and right side walls, thus suspending said bottom wall from the support surface for said container; and fork lift receiving means for receiving tines of a fork lift in facilitating dumping of refuse from said container, said receiving means attached to each of said left and right side walls.

2. A refuse container according to claim 1, wherein said bottom wall includes a cylindrical shape having an axis extending horizontally between said left and right side walls.

3. A refuse container according to claim 1, wherein the lower edge portions of said left and right side walls include a horizontally extending flange for providing a foot for said container.

4. A refuse container according to claim 1, wherein said left and right side walls have a rear edge portion of greater length dimension than a front edge portion, thus providing an inclined top wall opening into the chamber, said front side wall being shorter than said rear side wall.

5. A refuse container according to claim 1, wherein said fork lift receiving means comprises left and right sleeve members attached to each of said left and right side walls, said sleeve members having an opening for receiving the tine of the fork lift therein.

6. A refuse container according to claim 5, further comprising:

a flange horizontally extending from the lower edge portions of said left and right side walls thus providing a foot for said container; and a support member extending from and connected between the flange and the sleeve member for providing additional support to said container when positioned on the support surface, and for transmitting stress placed on the sleeves to the support surface through the support member, thus relieving said left and right side walls from the stress.

7. A refuse container according to claim 1, further comprising a peripheral flange portion defining a rim along a peripheral edge of the top wall opening into the chamber.

8. A refuse container according to claim 1, further comprising a lid hingedly attached to said container for covering the top wall opening.

9. A refuse container according to claim 1, wherein at least one of said left and right side walls includes a drain hole positioned proximate a bottom most position of said arcuate bottom wall.

10. A refuse container comprising:

left and right side walls each having lower edge portions for positioning on a support surface for said container; and a fixed cylindrically shaped bottom wall having a concave inner surface and a convex outer surface, and an axis extending horizontally between said left and right side walls, said bottom wall integrally formed with front and rear side walls, said bottom wall, front and rear side walls having left and right edge portions attached to said left and right side walls, respectively, said bottom wall attached to said left and right side walls in spaced relation to the lower edge portions of said left and right side walls, thus suspending said bottom wall from the support surface for said container.

11. A refuse container according to claim 10, further comprising left and right sleeve members attached to each of said left and right side walls, said sleeve members having an opening for receiving a fork lift.

12. A refuse container according to claim 11, wherein the lower edge portions of said left and right side walls include a horizontally extending flange for providing a foot for said container.

13. A refuse container according to claim 12, further comprising a support member extending from and connected between each flange and each sleeve member for providing additional support to said container when positioned on the support surface, and for transmitting stress placed on the sleeves to the support surface through the support member, thus relieving said left and right side walls from the stress.

14. A refuse container according to claim 13, wherein said left and right side walls have a rear edge portion of greater length dimension than a front edge portion, thus providing an inclined top wall opening into the chamber, said front side wall being shorter than said rear side wall.

15. A refuse container according to claim 14, further comprising a lid hingedly attached to said container for covering a top wall having an opening formed by top edge portions of said front, rear, left and right side walls.

16. A refuse container according to claim 15, wherein at least one of said left and right side walls includes a drain hole positioned proximate a bottom most position of said cylindrical shaped bottom wall.

17. A refuse container comprising:

left and right side walls each having lower edge portions for positioning on a support surface for said container;

front and rear side walls attached to said left and right side walls for forming a chamber having top and bottom openings; and a fixed arcuate bottom wall sealably attached to said side walls for closing the bottom wall opening, said bottom wall having a concave inner surface and a convex outer surface attached in spaced relation to an imaginary plane including the lower edge portions of said left and right side walls, thus suspending said bottom wall from the support surface for said container.

18. A refuse container according to claim 17, wherein said bottom wall includes a cylindrical shape.

19. A refuse container according to claim 17, further comprising fork lift receiving means for receiving tines of a fork lift in facilitating dumping of refuse from said container, said receiving means attached to an outer surface of each of said left and right side walls.

20. A refuse container according to claim 19, wherein said fork lift receiving means comprises left and right sleeve members attached to each of said left and right side walls, said sleeve members having an opening for receiving the tine of the fork lift therein.

21. A refuse container according to claim 17, wherein said left and right side walls have a rear edge portion of greater length dimension than a front edge portion, thus providing an inclined top opening, said front side wall being shorter than said rear side wall.

22. A refuse container according to claim 17, wherein the lower edge portions of said left and right side walls include a horizontally extending flange for providing a foot for said container.

23. A refuse container according to claim 17, further comprising a peripheral flange portion defining a rim along a peripheral edge of the top opening into the chamber.

24. A refuse container according to claim 23, further comprising a lid hingedly attached to the peripheral flange portion along a rear side wall for covering the top wall opening.

25. A method for fabricating a dumping styled refuse container useful for storing refuse and accommodating a fork lift for dumping refuse therefrom, the method comprising the steps of:

providing left and right side walls each having lower edge portions for positioning on a support surface for said container and front and rear side walls;

sealably attaching edge portions of said front and rear side walls to said left and right side walls, respectively, for defining a chamber having top and bottom wall openings;

providing an arcuate bottom wall;

fixedly attaching said arcuate bottom wall having a concave inner surface and a convex outer surface to said side walls in spaced relation to the lower edge portions of said left and right side walls, thus suspending said bottom wall from the support surface for said container, thus providing a chamber for receiving refuse through the top opening; and attaching fork lift receiving means to said left and right side walls for receiving tines of a fork lift in facilitating dumping of refuse from said container.

26. A method according to claim 25, wherein said bottom wall includes a cylindrical shape having an axis extending horizontally between said left and right side walls, said bottom wall having a concave inner surface for collecting refuse thereon.

27. A method according to claim 25, wherein said left and right side walls have a rear edge portion of greater length dimension than a front edge portion, thus providing an inclined top wall opening into the chamber, said front side wall being shorter than said rear side wall.

28. A method according to claim 25, further comprising the step of horizontally extending a flange from each of the lower edge portions of said left and right side walls for providing a foot for said container.

29. A method according to claim 28, wherein said fork lift receiving means attaching step comprises the steps of:

forming left and right sleeve members;

attaching each of said left and right sleeve members to said left and right side walls, said sleeve members having an opening for receiving the tine of the fork lift therein.

30. A method according to claim 29, further comprising the step of extending a support member from and connected between the flange and the sleeve member for providing additional support to said container when positioned on the support surface, and for transmitting stress placed on the sleeves to the support surface through the support member, thus relieving said left and right side walls from the stress.

31. A method according to claim 25, refuse container according to claim 1, further comprising a peripheral flange portion defining a rim along a peripheral edge of the top wall opening into the chamber.

32. A method according to claim 25, further comprising the steps of:

providing a lid; and hingedly attaching said lid to said container for covering the top opening.

33. A method according to claim 25, wherein at least one of said left and right side walls includes a drain hole positioned proximate a bottom most position of said arcuate bottom wall.

* * * * *

UNITED STATES PATENT AND TRADEMARK OFFICE

CERTIFICATE OF CORRECTION

PATENT NO. : 5,967,361
DATED : October 19, 1999
INVENTOR(S) : Darnell

It is certified that error appears in the above-identified patent and that said Letters Patent is hereby corrected as shown below:

Title page,
Item [63], please strike reference to Related U.S. Application Data including: "Continuation-in-part of application No. 29/063, 559, Dec. 10, 996, Pat No. Des. 389,970.

Column 1,
Lines 7-10, please strike lines 4-10 including "CROSS REFERENCE TO RELATED APPLICATION" through line 10 "No. D389,970."

Signed and Sealed this

Twenty-fifth Day of June, 2002

*Attest:*

*Attesting Officer*

JAMES E. ROGAN
*Director of the United States Patent and Trademark Office*